United States Patent [19]

Goszyk

[11] 4,453,222

[45] Jun. 5, 1984

[54] EMERGENCY DEVICE EMPLOYING PROGRAMMABLE VOCAL WARNING COMMANDS

[75] Inventor: Kurt A. Goszyk, Washington Crossing, Pa.

[73] Assignee: Exide Electronics Corporation, Philadelphia, Pa.

[21] Appl. No.: 369,406

[22] Filed: Apr. 19, 1982

[51] Int. Cl.[3] ..... G10L 1/00; G08B 19/00

[52] U.S. Cl. ..... 364/513.5; 340/521; 340/628; 340/663

[58] Field of Search ..... 179/1 SM; 340/692, 500, 340/501, 517, 519, 521, 588, 628, 654, 663, 692, 693; 364/184, 185; 381/51-53

[56] References Cited

U.S. PATENT DOCUMENTS

| | | | |
|---|---|---|---|
| 2,479,528 | 8/1949 | Villalobos | 177/355 |
| 3,310,793 | 3/1967 | Takarabe et al. | 340/221 |
| 3,582,949 | 6/1971 | Forst | 340/410 |
| 3,906,491 | 9/1975 | Gosswiller et al. | 340/409 |
| 4,107,464 | 8/1978 | Lynch et al. | 179/1 B |
| 4,135,143 | 1/1979 | Argentieri et al. . | |
| 4,275,274 | 6/1981 | English | 369/22 |
| 4,351,999 | 9/1982 | Nagamoto | 340/692 |

FOREIGN PATENT DOCUMENTS 1420603 1/1976 United Kingdom .

OTHER PUBLICATIONS

MSC (Master Specialties Company) Speech Synthesizer Brochure (apparently published Oct. 1974).

Cover Letter (undated), Advertising Brochures and Price Lists (effective Feb. 1, 1982) from EXIT-US, Inc., Easton, CT (Series MM, ML, Two Price Lists).

"Library Journal," p. 871, *R. R. Bowker Co.*, New York, NY, May 1, 1982.

*Primary Examiner*—E. S. Matt Kemeny

*Attorney, Agent, or Firm*—Eugene Chovanes

[57] ABSTRACT

A warning device (10), typically situated in an illuminated exit warning sign, broadcasts voice commands generated by a synthetic speech synthesizer (U3) via speaker (SP1). A programmable microcomputer (U2) senses a loss of AC power and generates a user initiated voice command. Upon the detection of a fire or smoke condition, the microcomputer (U2) generates a priority warning. The device (10) includes a self-contained, charged power supply (12) that powers the microcomputer (U2) and the synthesizer (U3) in the event that the externally supplied AC power ceases. Constant illumination is provided by lamps (32) or (40). A user operated switch aids in programming the microcomputer to provide two sets of audible phrases.

7 Claims, 4 Drawing Figures

EMERGENCY DEVICE EMPLOYING PROGRAMMABLE VOCAL WARNING COMMANDS

TECHNICAL FIELD

The disclosed invention relates to emergency warning apparatus in general and more particularly to a solid state, AC/self-powered warning device employing a user programmable, synthesized voice command system.

BACKGROUND ART

Due to the terror, confusion and panic engendered by fire, it was recognized early on to provide the public with means for alerting it of the dangers posed by fire and smoke. Alarms communicating with electromechanical noise generating devices such as sirens and horns were first utilized. Since it is believed that calm directions during an emergency may tend to alleviate some of the panic, more sophisticated devices employed detectors in conjunction with record players and tape playback mechanisms to sound the alarm and issue voice commands. However, these record playing and tape playback mechanisms are cumbersome and are prone to failure.

Similarly, public areas usually include illuminated signs pointing the way to an emergency egress.

A major drawback with these devices is that oftentimes a power interruption accompanies a fire, plunging an area into darkness and perhaps disabling the alarm means as well. Accordingly, the exit signs and warning devices are equipped with their own self-contained backup power supply (batteries). Means are provided to maintain the batteries in a float (fully charged) condition. Upon the initiation of an appropriate signal (fire, smoke, gas leak, power failure, etc.), the device may switch over to consume its internal power supply in order to drive the lamps and the voice signals even when utility supplied current is lost.

Representative designs include U.S. Pat. Nos. 4,275,274; 4,107,464; 3,582,949; 2,479,528; 3,310,793 and 3,906,491 and U.K. Pat. No. 1,420,603.

SUMMARY OF THE INVENTION

There is provided an illuminated, user programmable voice command warning device utilizing a single chip microcomputer for logic control of various sensor inputs and synthesized speech chip addressing. The device includes a self-contained power supply that will provide current in the event of a power failure. The device will detect fire, smoke, or loss of power condition and calmly announce the situation to the population while simultaneously maintaining illumination. Regardless of the power supply source, the lamps are continuously illuminated and the annunciator circuitry constantly monitors the environment. Upon the detection of an abnormal condition (fire, smoke, loss of power), the annunciator, essentially independent of the main power supply, will generate an appropriate voice command.

PREFERRED MODE FOR CARRYING OUT THE INVENTION

Figure 1:
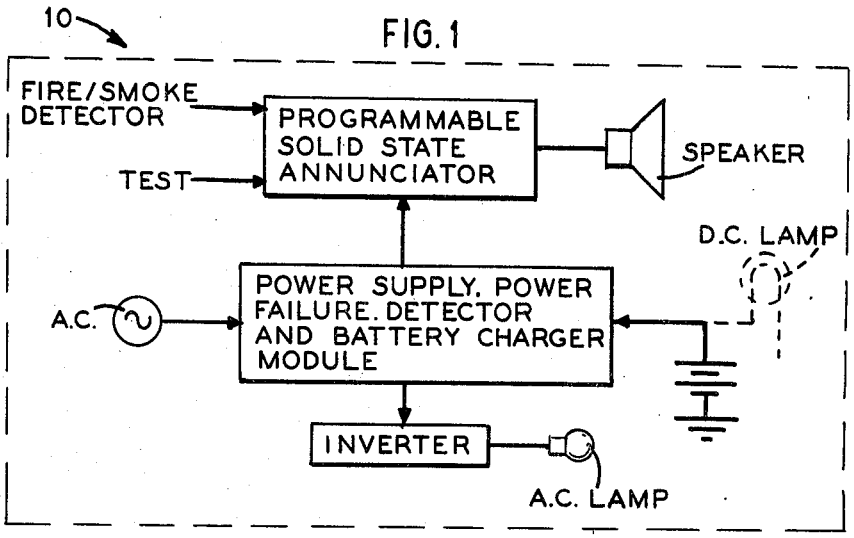
FIG. 1 is a block diagram of the invention.

Referring to FIG. 1, there is shown a block diagram of the warning device 10.

Under normal conditions (i.e., no fire present and available AC power), the lamps remain on, illuminating an exit sign or the like. Upon the detection of a fire or smoke condition, a preselected voice command will be generated by the annunciator. By the same token, in the event of a power failure, the unit will switch over to its secondary supply of power (the batteries) and generate a different command. The circuitry is designed so that in the event of a simultaneous fire and loss of power condition, the fire or smoke command will have precedence over the lost power status announcement.

Utility supplied AC power is normally utilized to maintain illumination, operate the annunciator and maintain the batteries in a fully charged condition. Should power fail for any reason, switching means will be energized to permit the batteries to directly supply power to the annunciator, inverter and lamps. In one embodiment, the DC output of the batteries to the lamps is inverted to AC.

Figure 2:
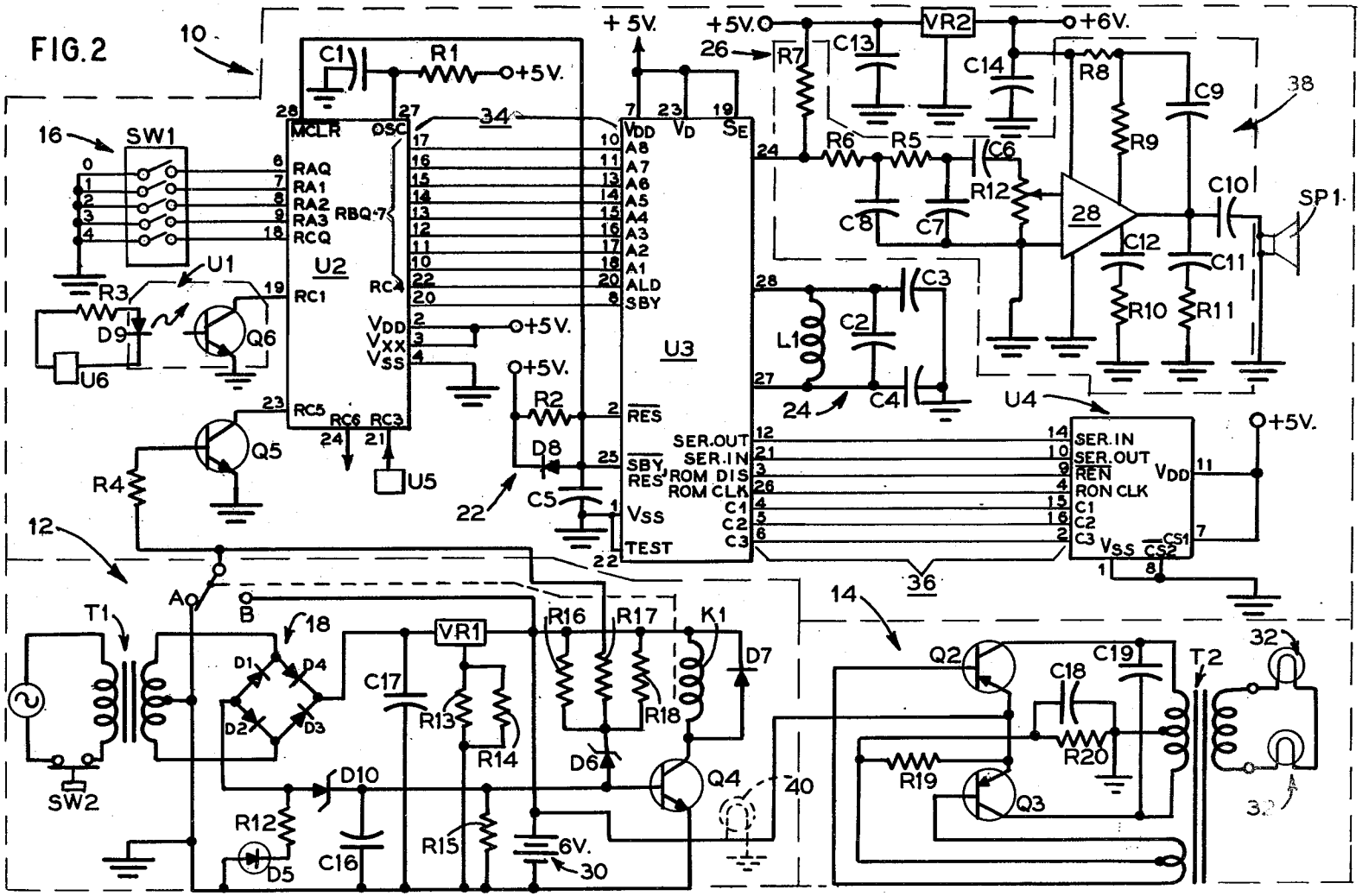
FIG. 2 is schematic diagram of the invention.

Reference is now made to FIG. 2. For the sake of convenience, the invention has been subdivided into three, albeit interrelated, subsections. Numeral 10 refers to the entire warning device. Numeral 12 refers to the power supply, power fail detector and battery charger module (hereinafter the "power supply"). Numeral 14 depicts the inverter stage that converts the DC output of the power supply 12 and the batteries into alternating current to illuminate the lamps. Numeral 16 refers to the programmable annunciator.

It should be understood that the above-referenced circuitry may be packaged into a suitable container having an appropriate written message ("Exit," "Stairwell," etc.) illuminated by the bulbs.

AC power (which may be 115 volts, 60 Hz or any other common rating) is supplied to transformer T1 which is connected to quad diode bridge 18. The bridge 18, including diodes D1 through D4, rectifies the alternating current to direct current. Voltage regulator VR1 provides a regulated 6 volt (DC) supply to the batteries 30 and to the inverter 14.

Filter capacitors C16 and C17 act in combination to reduce any transients (ripple) in the rectified DC output. Parallel resistors R13 and R14 operate the regulator VR1.

When AC is present, transistor Q4 is off and biased to open single pole double throw relay K1. The movable contact of relay K1 is normally in position A and grounded. Resistors R16, R17, R18, and R15 and zener diodes D6 and D10 act as a voltage divider circuit to provide the proper biasing current to the base of the transitor Q4. Moreover, light emitting diode (L.E.D.) D5 (and resistor R12) is activated in the presence of the AC power supply.

The rectified 6 volt DC power (previously treated by power supply charger 12) is supplied to the inverter 14. In the illustrated embodiment, the inverter 14 is a standard 60 Hz 120 volt AC output, over-driven, push-pull single transformer-coupled oscillator inverter. This inverter includes two push-pull oscillator transistors Q2 and Q3, a self-starting oscillator circuit comprised of resistor R20 and capacitor C18, a filter capacitor C19 and transformer T2. The transformer T2 is tapped to provide feedback to the transistors Q2 and Q3. The saturation impedence characteristic of transformer T2 is selected to provide the required current profile so as to drive AC lamps 32.

Upon the interruption of AC power, transistor Q4 is turned on thereby throwing the contact of relay K2 to position B. Current from the batteries now saturates transistor Q5 pulling its collector low. Transistor Q5, acting as a switch, activates the logic of the annunciator 16 to generate a voice command. Diode D7 acts in conjunction with relay K1 to dump excess energy when Q4 is cut off by the return of AC current.

The annunciator 16 consists essentially of four major components: (1) Microcomputer U2 provides the logic for the device 10; (2) Speech synthesizer U3 generates stored speech patterns; (3) Speaker SP1; and (4) Detectors U1 and U5.

The heart of the device 10 is the microcomputer U2. In the particular embodiment shown a General Instrument PIC 1655A (a MOS/LSI 8-bit microcomputer having an internal ROM [read only memory], a RAM [random access memory], and a number of I/O's [input-/output registers] for component interfacing ) is utilized (General Instrument Corporation, Hicksville, N.Y.). It should be understood that the invention is not limited to this microcomputer. Rather any comparable logic device may be utilized.

The microcomputer U2 exhibits flexibility to update vocabulary with no change to the circuitry. The microcomputer U2 is programmed so that any input combination of voice commands is acceptable.

Five position DIP (dual inline package) switch SW1 is utilized to generate the desired voice command or combinations thereof. By depressing any combination of switches, the microcomputer U2, when a loss of power condition is sensed, will address the synthesizer U3 to generate a selected signal to the speaker SP1.

A remote, conventional fire detector U6 serves to initiate a fire warning command that takes priority over the loss of power command. The detector U6 is connected to fire detector input U1 via resistor R3. The input U1 generates a signal to a photocoupled diode/-transistor pair D9/Q6 that triggers the microcomputer U2 to voice a fire command. A smoke detector U5 may be employed in a similar fashion.

The speech processor U3 is connected to the microcomputer U2 by address bus 34. In the embodiment shown, a General Instrument SP-0256 speech synthesizer is utilized. It is a single chip N-channel MOS/LSI device that, by utilizing its stored program, will synthesize speech. Auxiliary speech ROM U4 is utilized to provide additional off-chip memory. A serialized form of address/data is transmitted via address bus 36. As before, any comparable chip may be utilized as well.

The speech synthesizer U3 is connected to the speaker SP1 via a conventional amplifier section 38. Operational amplifier 28 steps up the audio output signal from the synthesizer U3 (pin 24) to provide the appropriate drive to the speaker SP1. The speaker SP1 is capacitively linked to the amplifier 28 by capacitors C10, C11, C12 and resistors R10 and R11 to eliminate undesirable DC components. A feedback network comprising capacitor C9 and resistors R8 and R9 provides the proper biasing to the amplifier 28. Potentiometer R12 controls the gain to the speaker SP1. A low pass filter network comprising capacitors C6, C7 and C8 and resistors R5 and R6 prevent high frequency noise from reaching the speaker SP1.

Although the device 10 essentially operates on 6 volts, the microcomputer U2 and speech synthesizer U3 require 5 volts. Accordingly, voltage regulator VR2 steps down the 6 volt output from the power supply/-charger 12 to 5 volts. Capacitors C13 and C14 prevent undesirable oscillating behavior and provide the requisite filtering and stability to the 5 volt output.

In order to generate intelligible commands, the synthesizer U3 utilizes a 3.12 MHz clock frequency. Accordingly, an on-chip LC oscillator 24 (the clock) and associated components consisting of capacitors C2, C3, C4 and induction coil L1 provide the requisite clock pulse.

By the same token, an on-chip RC oscillator circuit and associated components consisting of capacitor C1 and resistor R1 supply the appropriate clocking impulses to the microcomputer U2.

Power on/reset circuitry 22, comprising diode D8, resistor R2 and capacitor C5 properly initializes and resets both the microcomputer U2 and the synthesizer U3 when power is first applied to the device 10.

Test button SW2 simulates a loss of power condition by temporarily removing the line voltage to the power supply/charger 12.

The invention and the manner of applying it may perhaps be better understood by a discussion of the principles underlying the invention.

The microcomputer U2 is programmed to scan the inputs of the DIP switch SW1 only when the main power supply is interrupted. Upon a power failure, the microcomputer U2 will sample the inputs of the switch SW1 and generate the appropriate programmed address to the speech synthesizer U3 via bus 34. Upon depressing various switches on switch SW1, the user has the option of selecting the loss of power commands he sees fit. However, should a fire or smoke signal be detected, the loss of power function command is defeated, generating a unique priority fire or smoke message. Upon the resumption of line power and the removal of the fire or smoke signal, the annunciator 16 will again become quiescent. Should the fire and smoke signal be removed but the lack of power condition remain the device 10 will continue to voice the loss of power condition until the problem is rectified.

Attention is again directed to FIG. 2. For ease of discussion, the chip manufacturer's pin assignments and abbreviations have been utilized. However, it should be again emphasized that other similar function components manufactured by different suppliers may be utilized to similar advantage as well.

In the embodiment depicted, there are six phrases stored in the microcomputer U2. Of course, the number and content of the phrases may be increased, decreased or altered as conditions dictate. In the illustrated embodiment, the following phrases are utilized:

1. THIS WAY TO EXIT
2. YOU CAN EXIT HERE
3. PLEASE EXIT WITH CAUTION
4. A POWER FAILURE HAS OCCURRED, PLEASE REMAIN CALM
5. silence (three second pause)
6. ATTENTION, A FIRE ALARM HAS SOUNDED, PLEASE EXIT WITH CAUTION Phrase 5 allows the system to cycle responsive to a power failure stimulus but without generating a voice command.

Phrases from 1 through 5 are selectable by means of five switches (SW0–SW4) disposed within switch SW1 on the input lines to the microcomputer U2. The microcomputer U2 will recognize the "on" positions (logical 0) of the switches to be a selection of the corresponding phrase(s). Up to five phrases may be selected at the same time (see truth table 1 below). The selected phrase(s) is(are) triggered by the power failure signal generated by transistor Q5 (pin 23) which is TTL (transistor-transistor logic), active low. The phrase(s) will be repeated for as long as the power failure signal is active. A pause of selected length will occur between repeated phrases and between each phrase in a multiple phrase set.

TRUTH TABLE #1

| SW4 | SW3 | SW2 | SW1 | SW0 | Phrases in Order |
|---|---|---|---|---|---|
| | | | | | 5 (Silent) |
| | | | | X | 1 |
| | | | X | | 2 |
| | | | X | X | 1,2 |
| | | X | | | 3 |
| | | X | | X | 1,3 |
| | | X | X | | 2,3 |
| | | X | X | X | 1,2,3 |
| | X | | | | 4 |
| | X | | | X | 1,4 |
| | X | | X | | 2,4 |
| | X | | X | X | 1,2,4 |
| | X | X | | | 3,4 |
| | X | X | | X | 1,3,4 |
| | X | X | X | | 2,3,4 |
| | X | X | X | X | 1,2,3,4 |
| X | | | | | 5 (Silent) |
| X | | | | X | 1 |
| X | | | X | | 2 |
| X | | | X | X | 1,2 |
| X | | X | | | 3 |
| X | | X | | X | 1,3 |
| X | | X | X | | 2,3 |
| X | | X | X | X | 1,2,3 |
| X | X | | | | 4 |
| X | X | | | X | 1,4 |
| X | X | | X | | 2,4 |
| X | X | | X | X | 1,2,4 |
| X | X | X | | | 3,4 |
| X | X | X | | X | 1,3,4 |
| X | X | X | X | | 2,3,4 |
| X | X | X | X | X | 1,2,3,4 |

Figure 3:
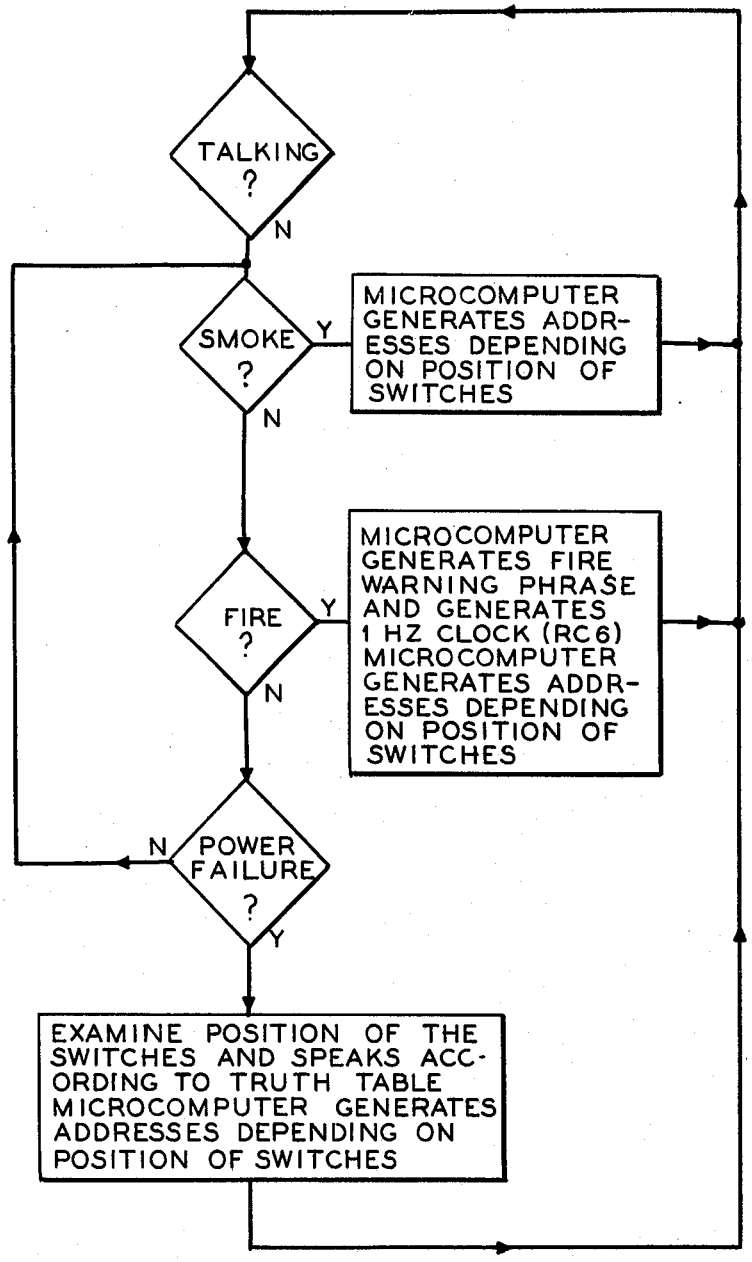
FIG. 3 is logic flowchart of the invention.

Another input signal (also TTL and active low) will trigger phrase 6 via pin 19. It is the fire alarm signal from fire alarm U1 which has priority over the power failure signal. When the fire signal is generated, phrase 6 is repeated for as long as the fire alarm signal is active. Also during the fire alarm, the microcomputer U2 will generate a 1 Hz clock with 50% duty cycle via pin 24. During this time, the power failure signal is ignored. See truth table #2 below and FIG. 3.

TRUTH TABLE #2

| Spare (Pin 21) | Fire (Pin 19) | Power Failure (Pin 23) | Microcomputer | Speech Synthesizer |
|---|---|---|---|---|
| F | F | T | Outputs an address 0–31 per switches continuously | Speaks per truth table |
| F | T | X | Outputs an address 32–63 (32 + switches) continuously | Speaks phrase #6 for all addresses 32–63 |
| T | X | X | Outputs an address 64–95 (64 + switches) continuously | Speaks, silence or crashes, depending on amount of ROM left over |

F + False (+5V.)
T + True (Ground)
X + Don't Care

One address entry point may be reserved if pin 21 becomes active (low). Pin 21 input has the highest priority and may be connected to the smoke detector U5. In such a case, an additional phrase concerning smoke may be utilized.

Figure 4:
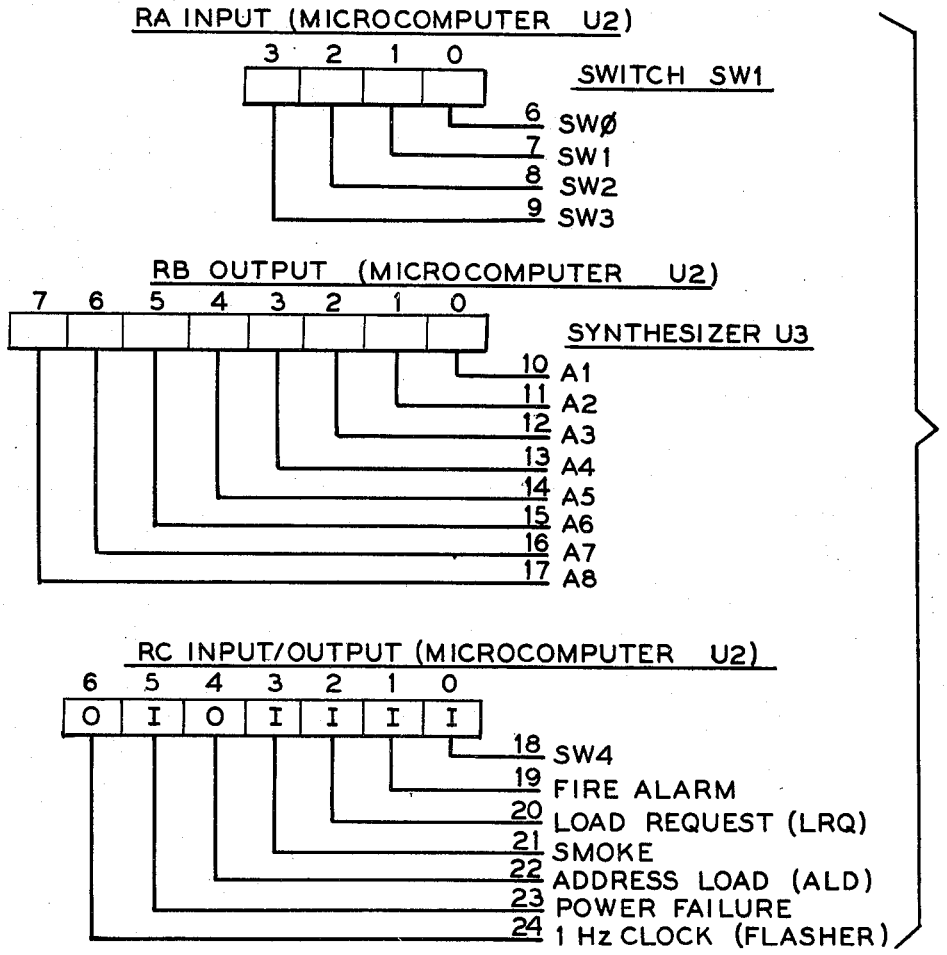
FIG. 4 is a diagram of the input/output register assignments.

FIG. 4 shows the input/output register assignments for the switch SW1, the microcomputer U2 and the speech synthesizer U3. RC 6 may be utilized (with associated circuitry) to flash the lamps 32 if desired.

It should be noted that the inverter 14 is continuously energized and on line. It never will perceive an interruption in power (i.e. flicker) should the AC power go down. Accordingly, the inverter 14 easily lends itself to both fluorescent and AC incandescent lamp applications. It should be further appreciated that the lamps 32 are always illuminated whether a power interruption or fire has occured. It is preferred to utilize alternating current lamps since they are inherently more reliable than direct current lamps.

An alternative embodiment to the above contemplates the device 10 without the inverter stage 14 and the lamps 32. In this instance the warning device 10 will act as an emergency status indicator only. That is, it will continuously monitor a number of stimuli (fire, smoke, power interruption) and should any occur, broadcast an appropriate warning. On the other hand, should it be desirable to eliminate the inverter 14 but retain illumination, direct current bulbs 40 may be directly connected to the output of the power supply 12. As before, the lamps will be continuously illuminated regardless of the emergency condition detected.

While in accordance with the provisions of the statute, there is illustrated and described herein specific embodiments of the invention. Those skilled in the art will understand that changes may be made in the form of the invention covered by the claims and that certain features of the invention may sometimes be used to advantage without a corresponding use of the other features.

The embodiments of the invention in which an exclusive property or privilege is claimed are defined as follows:

1. A verbal warning system, comprising
(a) an alternating-current power supply (T1);
(b) a direct-current standby power supply (30);
(c) means including rectifier means (18) connected with said alternating-current power supply for charging said direct-current standby power supply;
(d) illuminating means (32, 40) continuously energized by said direct-current standby power supply;
(e) means including a speech synthesizer (U3) and a speaker (SP1) for generating audio signals;
(f) normally de-activated means including a programmable microcomputer (U2) for operating said speech synthesizer to produce a plurality of audible phrases, and user operated switch means (SW1) for programming said microcomputer to provide first (1–5) and second (6) sets of audible phrases, respectively;

(g) first means (K1, Q5) for activating said microcomputer means in response to the loss of said alternating-current power supply to produce said first set of audible phrases; and (h) emergency condition means (U5, U6) for activating said microcomputer means in overriding higher priority relation to said first activating means to produce said second set of audible phrases.

2. Apparatus as defined in claim 1, and further including voltage regulator means (VR1) connected between said rectifier means and said direct-current standby power supply.

3. Apparatus as defined in claim 2, wherein said emergency condition responsive means includes a fire detector sensor (U6) connected with a first high priority input terminal (19) of said microcomputer.

4. Apparatus as defined in claim 3, wherein said emergency condition responsive means includes a smoke detector sensor (U5) connected with a second input terminal (21) of said microcomputer having a higher priority than said first high priority input terminal.

5. Apparatus as defined in claim 4, and further including means including a test button switch (SW2) for temporarily interrupting the supply of alternating-current power to the system.

6. Apparatus as defined in claim 5, wherein said illuminating means comprises at least one lamp of a type operable by alternating-current power, and further including inverter means (14) connected between said direct-current standby power supply and said lamps, thereby to supply inverted alternating current to said lamps.

7. Apparatus as defined in claim 5, wherein said first microcomputer activating means includes (1) a first transistor (Q4) including a pair of power circuit electrodes and a control electrode;

(2) relay means including a relay coil (K1), and a single role double throw relay contact operable from a first position (A) to a second position (B) upon energization of said coil, said relay coil and the power circuit electrodes of said first transistor being connected to define a series path that is connected in parallel across said direct-current standby power supply;

(3) means including a second transistor (Q5) for sending a power failure signal to said microcomputer, said second circuit having a pair of power circuit electrodes connected with an input terminal of said microcomputer, and a control electrode connected with the movable contact of said relay means, said first and second relay contact positions being operable to connect said movable contact with ground and with one pole of said direct-current standby power supply; and (4) means (R15–R18, D6, D10) for supplying biasing current to the control electrode of said first transistor to normally maintain the relay contact in the first position in the presence of the alternating-current power supply.

* * * * *